United States Patent [19]

Suzuki

[11] 4,179,968

[45] Dec. 25, 1979

[54] ELECTRONIC MUSICAL INSTRUMENT

[75] Inventor: Hideo Suzuki, Hamamatsu, Japan

[73] Assignee: Nippon Gakki Seizo Kabushiki Kaisha, Hamamatsu, Japan

[21] Appl. No.: 841,717

[22] Filed: Oct. 13, 1977

[30] Foreign Application Priority Data

Oct. 18, 1976 [JP] Japan ..... 51-124528

[51] Int. Cl.[2] ..... G10H 1/00

[52] U.S. Cl. ..... 84/1.01; 84/1.24

[58] Field of Search ..... 84/1.01, 1.08, 1.1, 84/1.24, 1.27, DIG. 7, DIG. 8, DIG. 2, DIG. 20, DIG. 23

[56] References Cited

U.S. PATENT DOCUMENTS

| | | | |
|---|---|---|---|
| 3,828,110 | 8/1974 | Colin | 84/1.01 |
| 3,986,426 | 10/1976 | Faulhaber | 84/1.23 |
| 3,991,645 | 11/1976 | Luce et al. | 84/1.01 |
| 4,018,125 | 4/1977 | Nishimoto | 84/1.19 |

*Primary Examiner*—Vit W. Miska

*Attorney, Agent, or Firm*—Spensley, Horn, Jubas & Lubitz

[57] ABSTRACT

An electronic musical instrument comprises a circuits for generating two kinds of voltages of tone pitch voltages and control voltages both of which correspond to respective keys but are independent of each other. In the control voltage generating circuit, a voltage applied to a single voltage division circuit is switched in its value and polarity according to octave information. Output of this voltage division circuit is selectively delivered out according to note name information thereby to control musical elements in a musical tone.

7 Claims, 5 Drawing Figures

ELECTRONIC MUSICAL INSTRUMENT

BACKGROUND OF THE INVENTION

This invention relates to an electronic musical instrument, and more particularly to an improvement of an electronic musical instrument embodying to a system in which a tone pitch, a tone color and volume of a musical tone controlled by the use of voltage control type circuits.

In general, in an electronic musical instrument called a music synthesizer, voltages corresponding to the tone pitches of respective keys (hereinafter referred to as "tone pitch voltages" when applicable) are produced in response to the depression of the keys, thereby controlling the operation of a voltage control type oscillator to produce tone signals having frequencies corresponding to the tone pitches of the depressed keys. The tone pitch voltages corresponding to the keys are set by a resistance type voltage division circuit or the like. However, the tone pitch voltages are fixedly set in accordance with a predetermined temperament, for instance an equal temperament, and therefore it is impossible to obtain musical scales other than those conforming to the predetermined temperament.

In order to overcome this difficulty, an electronic musical instrument has been proposed in the U.S. patent application Ser. No. 770,718 filed on Feb. 22, 1977 and assigned to the same assignee as the present application. In this electronic musical instrument, control voltages corresponding to the keys or the octave range of the keys (hereinafter referred to as "key corresponding control voltages" when applicable) are produced in addition to the aforementioned tone pitch voltages, and the sums of the tone pitch voltages and the key corresponding control voltages, or voltages obtained by mixing these two kinds of voltages are employed to control the oscillation frequencies of a voltage control type oscillator thereby to obtain scales according to temperaments other than the temperament predetermined by the tone pitch voltages. In addition the key corresponding control voltages are employed to control various tonal elements such as tone pitches, tone colors, and volumes thereby to improve the effects in performance. However, in this electronic musical instrument since positive and negative voltages are required to be produced by a circuit for generating the key corresponding control voltages a resistance type voltage division circuit for providing positive voltages and a resistance type voltage division circuit for providing negative voltages should be provided in the control voltage generating circuit, as a result of which the circuitry of the electronic musical instrument is rather intricate.

SUMMARY OF THE INVENTION

Accordingly, an object of this invention is to eliminate the above-described difficulties accompanying a conventional electronic musical instrument.

More specifically, an object of the invention is to provide an electronic musical instrument which can be manufactured at a relatively low cost by simplifying the aforementioned key corresponding control voltage generating circuit, and in which it is possible to select a desired temperament.

Another object of the invention is to provide an electronic musical instrument capable of controlling the variety of musical tone elements.

In order to achieve the foregoing objects the voltages and the polarity thereof applied to the voltage division circuits in the key corresponding control voltage generating circuit are switched according to octave information, and control voltages are obtained from the voltage division circuits according to note name information, thereby to decrease the number of the voltage division circuits to simplify the circuit.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings.

DETAILED DESCRIPTION OF THE INVENTION

Figure 1:
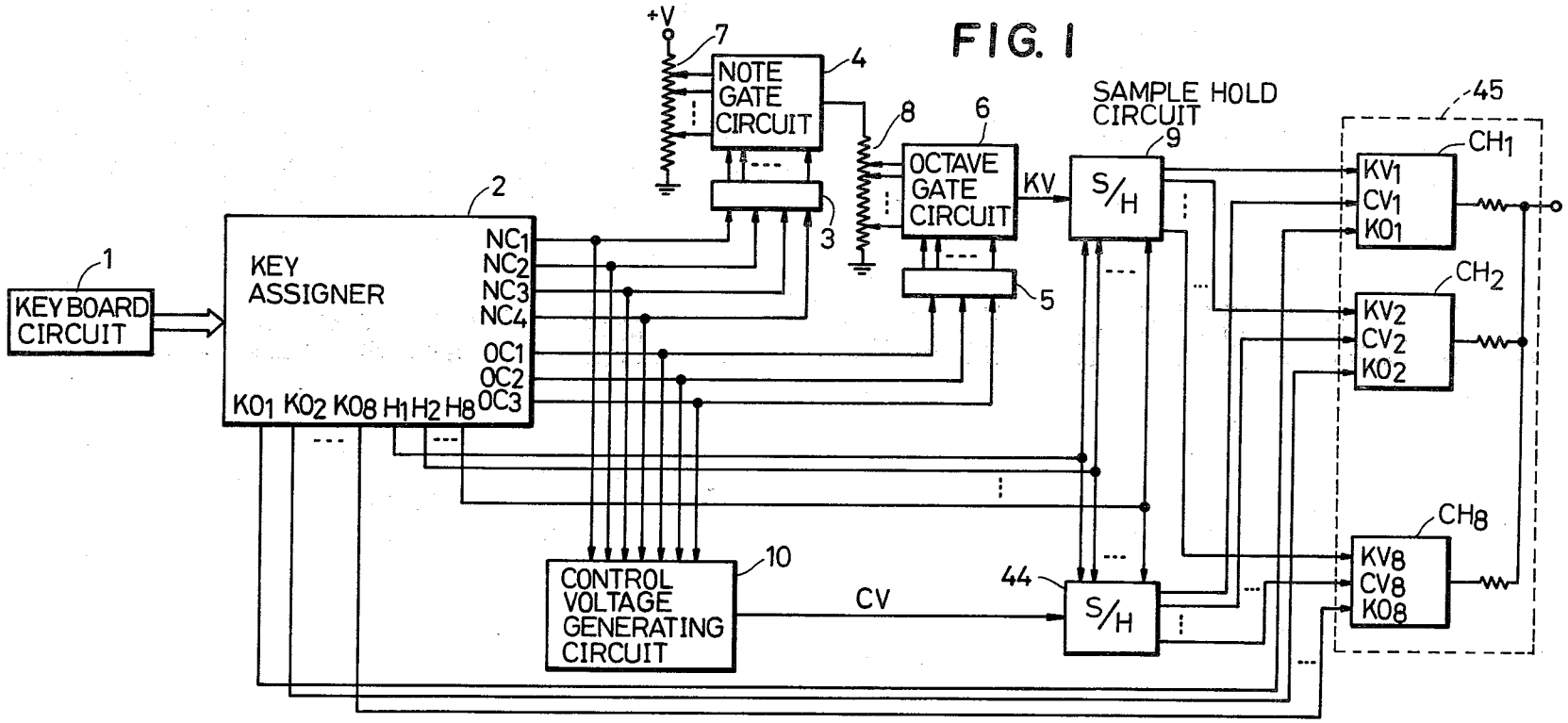
FIG. 1 is a block diagram illustrating one embodiment of an electronic musical instrument according to this invention.

One embodiment of an electronic musical instrument according to this invention is shown in FIG. 1. A keyboard circuit 1 is made up of a group of key switches (not shown) operated by depression of keys, and operates to detect the "on" or "off" state of each key and to apply information on keys in "on" state to a key assigner 2. According to the information on keys in the "on" state, the key assigneer 2 generates code signals (binary information) representative of the key switches (the keys) and to assign the code signals thus generated to respective channels $CH_1$ through $CH_8$ in time-division manner.

Figure 2:
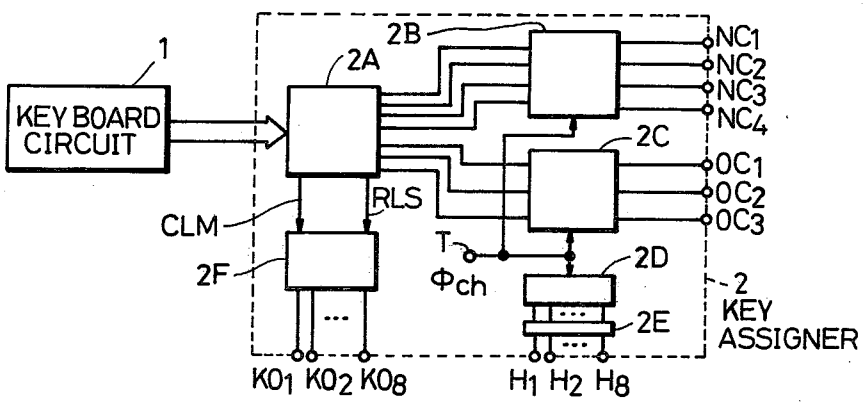
FIG. 2 is a detailed block diagram showing one example of a key assignor in FIG. 1.

A concfete example of the key assignor 2 is shown in FIG. 2. In the circuit shown in FIG. 2, the information from the key switches in the keyboard circuit 1 corresponding to respective keys are applied to a code signal forming circuit 2A which operates to form and store code signals corresponding to the key switches (the keys) turned on. The code signal is constituted by the combination of a 4-bit note code $NC_1$, $NC_2$, $NC_3$, $NC_4$ representative of the note of a key and a 3-bit octave code $OC_1$, $OC_2$, $OC_3$ representative of the octave range to which the key belongs. Examples of the note code $NC_1$–$NC_4$ and the octave code $OC_1$–$OC_3$ are indicated in Table 1 and Table 2, respectively.

Table 1

| Note | Note code | | | |
|---|---|---|---|---|
| | $NC_4$ | $NC_3$ | $NC_2$ | $NC_1$ |
| C# | 0 | 0 | 0 | 0 |
| D | 0 | 0 | 0 | 1 |
| D# | 0 | 0 | 1 | 0 |
| E | 0 | 1 | 0 | 0 |

Table 1-continued

| Note | Note code | | | |
|---|---|---|---|---|
| | $NC_4$ | $NC_3$ | $NC_2$ | $NC_1$ |
| F | 0 | 1 | 0 | 1 |
| F# | 0 | 1 | 1 | 0 |
| G | 1 | 0 | 0 | 0 |
| G# | 1 | 0 | 0 | 1 |
| A | 1 | 0 | 1 | 0 |
| A# | 1 | 1 | 0 | 0 |
| B | 1 | 1 | 0 | 1 |
| C | 1 | 1 | 1 | 0 |

Table 2

| Octave Range | Octave Code | | |
|---|---|---|---|
| | $OC_3$ | $OC_2$ | $OC_1$ |
| 1 | 0 | 0 | 0 |
| 2 | 0 | 0 | 1 |
| 3 | 0 | 1 | 0 |
| 4 | 0 | 1 | 1 |
| 5 | 1 | 0 | 0 |

The code signals formed by and stored in the code signal forming circuit 2A, that is, the combinations of the note code signals $NC_1$–$NC_4$ as listed in Table 1 and the octave code signal $OC_1$–$OC_3$ as listed in Table 2 are assigned to the channels $CH_1$ through $CH_8$ and are delivered out in time-division manner. The note code signal $NC_1$–$NC_4$ and the octave code signal $OC_1$–$OC_3$ thus delivered out are successively applied to synchronization circuits 2B and 2C, respectively. The synchronization circuits 2B and 2C are to convert the aforementioned time-division code signal into a time-division signal synchronized with a low rate channel clock signal $\phi$ch supplied to a terminal T. More specifically, the circuit 2B operates to output the note code signals $NC_1$–$NC_4$, and the circuit 22b to output the octave code signals $OC_1$–$OC_3$ in synchronism with the low rate channel clock signal $\phi$ch.

The channel clock signal $\phi$ch is further applied to a channel counter 2D where the clock signals are counted. The count value of the channel counter 2D is decoded by a decoder 2E thereby to obtain eight channel gate signals $H_1$ through $H_8$. In this connection, the rate of the channel clock signal $\phi$ch is determined by taking into account the time constant of a signal holding capacitor in a sample hold circuit described later and so forth, and is lower than the rate of the clock signal for the above-described code signal forming circuit 2A.

On the other hand, the code signal forming circuit 2A delivers out in time-division manner a claim signal CLM representative of the depression of the key and a release signal RLS representative of the release of the key in synchronism with the aforementioned code signal. The signal CLM and RLS thus delivered are applied to a key-on signal generating circuit 2F. This circuit 2F is made up of a D-latch, for instance. This circuit 2F operates to latch a high level signal with the aid of the claim signal CLM, and to reset the latched signal with the aid of the release signal RLS. Accordingly, the key-on signal generating circuit 2F generates key-on signals $KO_1$ through $KO_8$ whose levels are high when keys assigned to the respective channels are depressed, and whose levels are low when the keys are released.

Thus, the key assigner 2 delivers out the note code signals $NC_1$–$NC_4$, the octave code signals $OC_1$–$OC_3$ both in time-division and synchronism with the channel clock signal $\phi$ch, the channel gate signals $H_1$–$H_8$, and the key-on signal $KO_1$–$KO_8$ representative of the depression of the keys.

The note code signals $NC_1$ through $NC_4$ are applied from the key assigner 2 through a note decoder 3 to a note gate circuit 4, while the octave code signal $OC_1$ through $OC_3$ are applied from the key assigner 2 through an octave decoder 5 to an octave gate circuit 6.

EAch of tone pitch voltage generating circuits 7 and 8 is made up of a resistance type voltage division circuit so as to generate a tone pitch voltage corresponding to the tone pitch of each key in the keyboard circuit 1. In the circuit 7, voltages corresponding the frequencies of twelve notes C, C# . . . B in one octave (for instance, the highest octave), are produced. The voltages thus produced are applied, as voltages for voltage division, to the circuit 8 through the aforementioned note gate circuit 4. In the circuit 8, the voltages corresponding to given notes are subjected to voltage division per octave; more specifically, voltages corresponding to the frequencies of given notes in respective octaves in the range from the first octave to the fifth octave are provided. These voltages are obtained through the octave gate circuit 6. Therefore, in the note gate circuit 4, note voltages corresponding to relevant notes are obtained from the circuit 7 in response to gate control signals applied thereto according to notes (hereinafter referred to as "note corresponding gate control signals" when applicable), while voltages corresponding to relevant notes and octaves, namely, tone pitch voltages are obtained from the octave gate circuit 6 in response to gate control signals applied thereto according to octaves (hereinafter referred to as "octave corresponding gate control signals" when applicable).

When, for instance, the note code "1110" and the octave code "001" corresponding to the tone C in the second octave are provided by the key assigner 2, a note voltage for the note C is obtained from the circuit 7, and a tone pitch voltage KV corresponding to the note C of the second octave is provided by the circuit 8. In this manner, tone pitch voltage KV are generated in time-division manner in response to code signals from the key assigner 2, and then applied to the sample hold circuit 9.

The sample hold circuit 9 comprises eight gates and signal holding capacitors (both not shown). This circuit 9 operates to successively sample the tone pitch voltages KV in synchronism with the channel gate signals $H_1$ through $H_8$ applied thereto from the key assigner 2, thereby to obtain tone pitch voltages $KV_1$ through $KV_8$ assigned respectively to the channels $CH_1$ through $CH_8$. These tone pitch voltages are held by the signal holding capacitors mentioned above.

The note code signals $NC_1$ through $NC_4$ znd the octave code signals $OC_1$ through $OC_3$ are applied to a circuit 10 adapted to generate control voltages according to keys (hereinafter referred to as "key corresponding control voltage generating circuit 10" when applicable).

Figure 3:
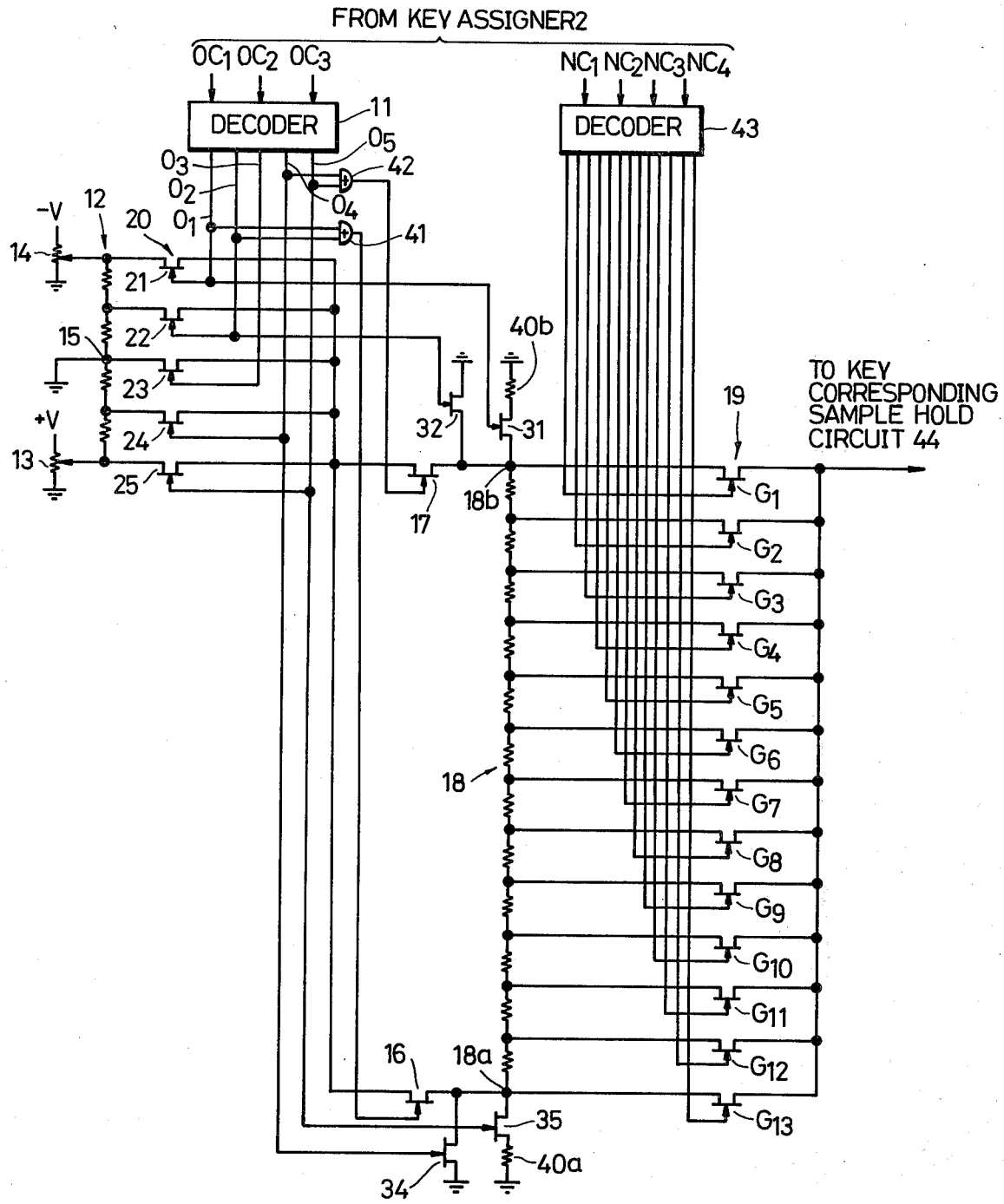
FIG. 3 is a circuit diagram illustrating one example of a key corresponding control voltage generating circuit in FIG. 1.

This circuit 10, in response to the code signals $NC_1$ through $NC_4$ and $OC_1$ through $OC_3$ applied thereto, produces control voltages $CV_1$ through $CV_8$ corresponding to the keys represented by the codes and in the channels to which the tone productions of those keys are assigned. A detailed example of the circuit 10 is shown in FIG. 3.

The octave code signal $OC_1$ through $OC_3$ is applied to a decoder 11 where it is decoded onto five output lines $0_1$ through $0_5$ corresponding respectively to the first, second, third, fourth and fifth octaves. For instance, if the octave code signal $OC_1$ through $OC_3$ is "001" representative of the encod octave, then a signal "1" is provided on the line $0_2$.

The signals on the line $0_1$ through $0_5$ are applied, as gate control signals, to gates 21 through 25 in an octave gate circuit 20.

This octave gate circuit 20 operates to obtain voltages corresponding to the octaves from a resistance type voltage division circuit 12.

A positive voltage +V and a negative voltage −V are applied to two ends of the voltage division circuit 12 through variable resistors 13 and 14, respectively. The voltage division circuit 12 has five voltage division taps, the center tape 15 of which is grounded. Accordingly, the potential at the center tap 15 is zero, and positive potentials and negative potentials are provided at the remaining taps. These various potentials are applied to the gates 21 through 25 of the aforementioned octave gate circuit 20, and the gates are controlled by the signals on the lines $0_1$ through $0_5$.

The outputs of the gates 21 through 25 are applied through gates 16 and 17 to the terminals 18*a* and 18*b* of a voltage signal generating circuit 18. The terminal 18*a* is grounded through a gate 34 and through a gate 35 and a resistor 40*a*, while the terminal 18*b* is grounded through a gate 32 and through a gate 31 and a resistor 40*b*.

The signals on the lines $0_1$, $0_2$, $0_4$ and $0_5$ corresponding respectively to the first, second, fourth and fifth octaves are applied, as gate control signals, to gates 31, 32, 34 and 35. The signals on the lines $0_1$ and $0_2$ are applied, as gate control signals, to a gate 16 through an OR circuit 41. The signals on the lines $0_4$ and $0_5$ are applied, as gate control signals, to a gate 17 through an OR circuit 42.

Accordingly, if a signal "1" is provided on the line $0_1$ corresponding to the first octave, then the gates 21, 16 and 31 are opened, a negative voltage corresponding to the first octave is applied to the terminal 18*a* of the voltage signal generating circuit 18 through the gates 21 and 16, and the terminal 18*b* is grounded through the gate 31 and the resistor 40*b*.

Similarly as in the above-described case, if a signal "1" is provided on the line $0_2$ corresponding to the second octave, then the gates 22, 16, and 32 are opened, a negative voltage corresponding to the second octave is applied through the gate 22 and 16 to the terminal 18*a*, and the terminal 18*b* is grounded through the gate 32.

When a signal "1" is provided on the line $0_3$ corresponding to the third octave, the gate 23 is opened; however, as the output thereof is at the earth potential and the other gates are not opened, no voltage is applied to the terminals 18*a* and 18*b*.

If a signal "1" is provided on the line $0_4$ corresponding to the fourth octave, the gates 24, 17 and 34 are opened, the terminal 18*a* is grounded through the gate 34, and a positive voltage corresponding to the fourth octave is applied to the terminal 18*b* through the gates 24 and 17.

Similarly, if a signal "1" is provided on the line $0_5$ corresponding to the fifth octave, the gates 25, 17 and 35 are opened, the terminal 18*a* is grounded through the gate 35 and the resistor 40*a*, and a positive voltage corresponding to the fifth octave is applied to the terminal 18*b* through the gates 25 and 17.

Thus, the voltages of positive polarity or negative polarity according to the octaves are applied to the terminals 18*a* and 18*b* of the voltage signal generating circuit 18 in response to the octave code signals $OC_1$ through $OC_3$ from the key assigner 2.

The voltage signal generating circuit 18 is made up of a plurality of resistors series-connected. In this resistance ladder circuit 18, a voltage applied across the terminals 18*a* and 18*b* thereof is divided into various voltages corresponding to the notes C, C# . . . , B, C. The voltages thus obtained are applied to gates $G_1$ through $G_{13}$ in a tone gate circuit 19.

On the other hand, the note code signals $NC_1$–$NC_4$ from the key assigner 2 are decoded by a decoder 43 onto thirteen lines $N_1$ through $N_{13}$ corresponding to the notes C, C# . . . B and C represented by the note code signals $NC_1$–$NC_4$, and are applied, as gate control signals, to the gates $G_1$ through $G_{13}$ in the note gate circuit 19.

Figure 4:
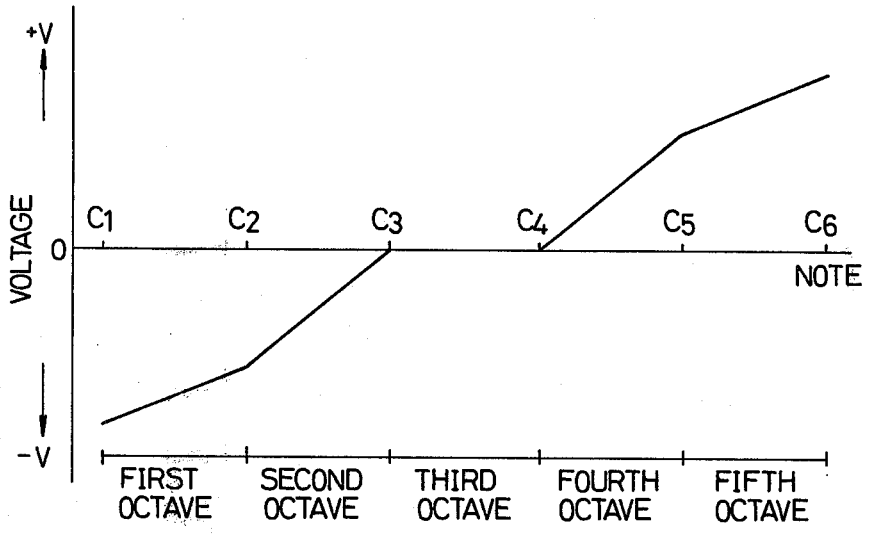
FIG. 4 is a graphical representation indicating one example of an output voltage of the key corresponding control voltage generating circuit.

The gates of the gate circuit 19 are controlled by the gate control signals from the aforementioned decoder 43, as a result of which voltages corresponding to the note code signals $NC_1$–$NC_4$ and to the octave code signals $OC_1$–$OC_3$ applied to the above-described decoder 11 are obtained. FIG. 4 is a graphical representation indicating one example of a control voltage according to the keys (hereinafter referred to as "a key corresponding control voltage" when applicable). In this graph, the ordinate represents voltages, while the abscissa represents key names. As is apparent from the graph, negative control voltages are provided for the first and second octaves, control voltage for the third octave is zero, and positive control voltages are provided for the fourth and fifth octaves. Thus, the key corresponding control voltage which varies gradually according to the note names is obtained.

In the electronic musical instrument having three octaves, namely, the second, third and fourth octaves, the provision of the gates 31, 35 and resistors 40*a* and 40*b* are not necessary, but only the gates 16, 17 32 and 34 are to be provided.

As was described, application of the octave code signals $OC_1$–$OC_3$ and the note code signals $NC_1$–$NC_4$ are effected in time-division manner in synchronism with the channel clock signal $\phi h$ by the key assigner 2. Therefore, the key corresponding control voltages shown in FIG. 4 are outputted in time-division manner in snychronism with the channel clock signal $\phi ch$ by the key corresponding control voltage generating circuit 10.

This time-division key corresponding control voltage signal CV is applied to a key corresponding control voltage sample hold circuit 44 (FIG. 1) which is similar to the aforementioned tone pitch voltage sample hold circuit 9. The circuit 44 operates to sample the control voltage signals CV is synchronism with the channel gate signals $H_1$ through $H_8$ produced by the key assigner 2, and to hold the sampled control voltages $CV_1$ through $CV_8$ corresponding to the channels.

The tone pitch voltages $KV_1$ through $KV_8$ and the control voltages $CV_1$ through $CV_8$ held respectively by the sample hold circuit 9 and 44 are applied to the channels CH1 through CH8 of a musical tone forming circuit 45.

Figure 5:
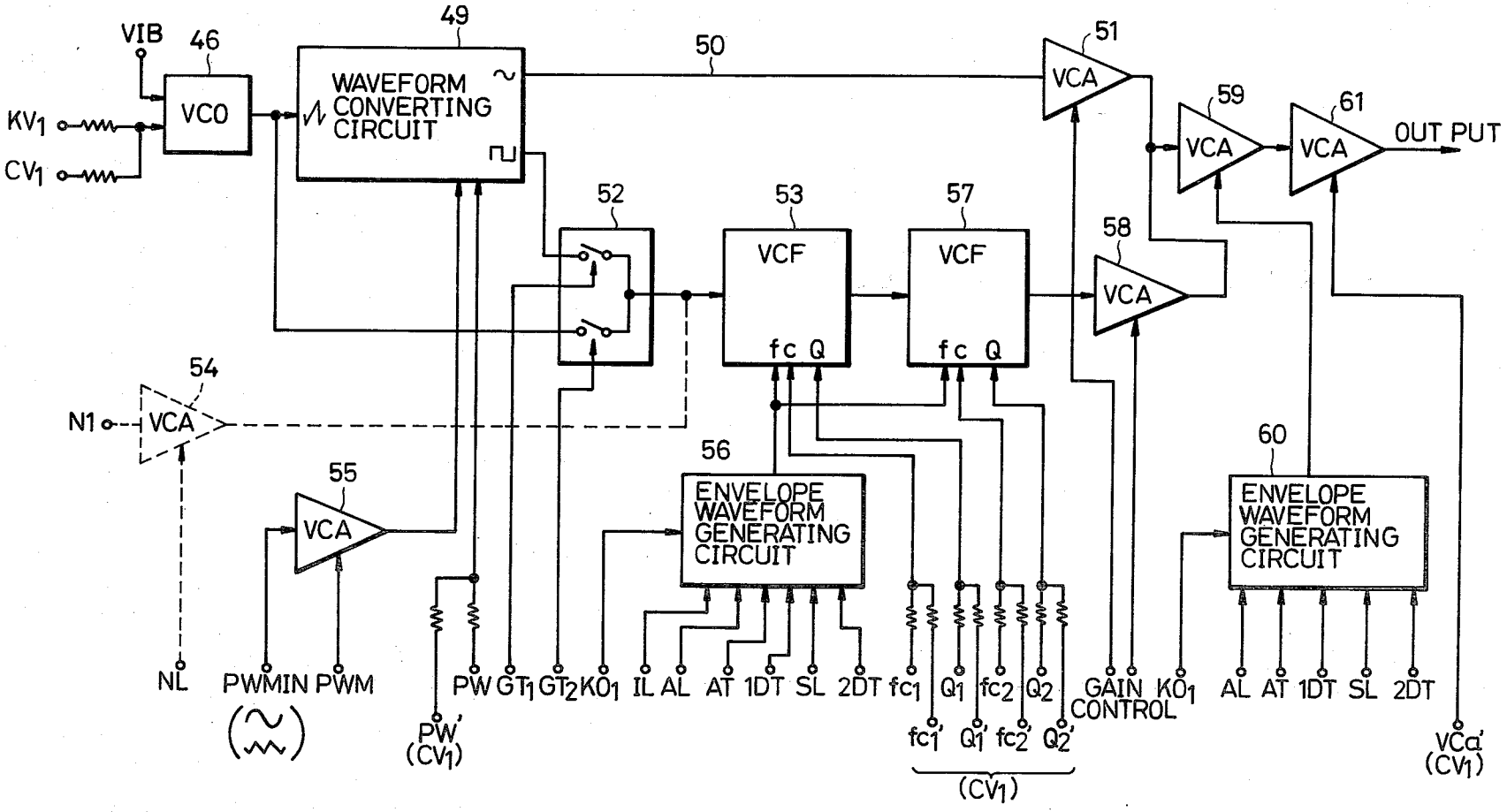
FIG. 5 is a block diagram showing one example of a musical tone forming circuit in FIG. 1 with respect to one channel only.

This musical tone forming circuit 45 serves to form different tones in the different channels CH1 through CH8. For instance, such circuit for the channel CH1 is shown in FIG. 5.

The tone pitch voltage $KV_1$ and the key corresponding control voltage $CV_1$ are applied to the control input of a voltage control type oscillator (VCO) 46 after mixed through resistance. Therefore, a tone signal (such as a saw tooth wave signal) having a frequency corresponding to the sum ($KV_1+CV_1$) of the voltage $KV_1$ and $CV_1$ is obtained from the VCO 46. In this case, if the tone pitch voltage $KV_1$ is set in accordance with an equal temperament, a pure temperament scale can be obtained by the addition of the control voltage $CV_1$.

A vibrato control signal VIB is applied to the VCO 46 for a vibrato effect. The saw tooth wave is converted into a sinusoidal wave and a rectangular wave by means of a waveform converting circuit 49. The sine wave signal is applied through a line 50 to a voltage control type amplifier (VCA) 24. The rectangular wave signal is applied to a voltage control type filter (VCF) 53 when selected by a selection circuit 52. The saw tooth wave signal is selected by a signal $GT_2$ and is applied to the VCF 53. In the case of using a noise signal NI, the noise signal is applied to the VCF 53 after the noise level is suitably controlled with the aid of a noise level control voltage signal NL in a VCA 54.

The duty ratio of a rectagular wave signal obtained by a waveform converting circuit 49 is controlled by a duty ratio control voltage PW. If a control voltage PW' corresponding to the key corresponding control voltage $CV_1$ is mixed with the voltage PW and is then applied to the circuit 49, it is possible to vary the duty ratio of the rectangular wave signal in accordance with the depressed key, that is, the harmonic components in the tone can be changed.

In the case of periodically changing the duty ratio, a pulse width modulation signal PWMIN (such as a low frequency sinusoidal wave) is applied to the waveform converting circuit 49 after suitably controlled by a VCA 55 in accordance with a gain control voltage PWM.

The VCF 53 is a low-pass filter for instance, and its cut-off frequency is controlled with time by an envelope-shaped cut-off frequency control voltage which is supplied from an envelope waveform generating circuit 56 and varies with time. Furthermore, another cut-off frequency control signal $fc_1$ (for controlling lasting factor in a tone color, for instance) is applied to the VCF 53, while a voltage $Q_1$ for controlling the quality factor Q of the filter is applied to the same. After mixed with a voltage $fc_1$ or $Q_1$, a control voltage $fc_1$, or $Q_1'$ corresponding to the key corresponding control voltage $CV_1$ is applied to the VCF 53. As a result, it is possible to vary the cut-off frequency and quality factor Q of the low-pass filter in correspondense to the depressed key, thus providing intricate tone color variation.

The output of the VCF 53 is applied to a VCF 57 constituting a high-pass filter. A control voltage adapted to vary the cut-off frequency with time is supplied to the VCF 57 from the envelope waveform generating circuit 56, and in addition a cut-off frequency control voltage $fc_2$ (for instance, for controlling a lasting factor in tone color) and a quality factor control voltage $Q_2$ are also applied to the VCF 57. Similarly as in the case of the VCF 53, a control voltage $fc_2'$ or $Q_2'$ is applied to the VCF 57 after mixed with the voltage $fc_2$ or $Q_2$. As a result, it is possible to change the cut-off frequency or the quality factor of the high-pass filter in correspondence to the depressed key.

The output of the voltage control type high-pass filter 57 is applied to a voltage control type amplifier 58. The sinusoidal wave signal applied to the aforementioned voltage control type amplifier 51 contains substantially the fundamental wave component only, while the signal applied to the amplifier 58 is one in which the harmonic components are suitably controlled. After being amplified by the amplifiers 51 and 58, these musical tone signals are mixed and are then applied to a VCA 59. This VCA 59 is provided to give an amplitude envelope of the musical tone. The gain of the VCA 59 is controlled by an evelope-shaped control voltage supplied from an envelope waveform generating circuit 60, thereby to provide musical tone amplitude envelope characteristics such as attack, decay, and sustain characteristics. The musical tone signal whose amplitude envelope has been controlled is applied to a VCA 61. As the gain of the VCA 61 is controlled by a control voltage VCa' corresponding to the key corresponding control voltage $CV_1$, the maximum amplitude of the amplitude envelope, or the volume of the generated tone is controlled according to the depressed key.

An envelope shape generating circuit 56 or 60 generates an envelope of attack characteristic for instance, upon application of a key-on signal $KO_1$ thereto from the key-on signal generating section 25(FIG. 2), and after maintaining a sustain level, generates an envelope of decay characteristic upon disappearance of the key-on signal $KO_1$, thus generating an envelope shape having a series of attack, sustain and decay characteristics. An initial level control signal IL applied to the envelope shape generating circuit 56 is to set a level at the beginning of the envelope, an attack level control signal AL applied thereto is to set a maximum level at the rising portion of the envelope, an attack time control signal AT applied thereto is to set an attack duration time, a first decay time control signal IDT is to set the duration of a decaying portion from the attack termination to the sustain start, a sustain level control signal SL applied thereto is to set a sustain level, and a second decay time control signal 2DT applied thereto is to set the duration of a decaying portion observed when a key is released after the sustain termination. The case is the same with the envelope shape generating circuit 60. The shape of the envelope generated is varied by the above-described various control signals. Accordingly, when the key corresponding control signal $CV_1$ produced by the key corresponding control voltage generating circuit 10 is applied to the envelope shape generating circuits 56 and 60 to control relevant envelope elements, variations with time of tone color and volume can be varied in response to keys depressed.

The key corresponding control voltage $CV_1$ may be employed, as it is, as the various control voltages PW', $fc_1'$, $Q_1'$, $fc_2'$, $Q_2'$ and $VC_a'$. However, the various control voltages PW' through $VC_a'$ may be obtained through a suitable scaler (not shown) to suitably control the value of the control voltage, $CV_1$. Therefore, it may be possible to select these various control voltages through a selection circuit (not shown) as required and to apply the selected control voltages to the circuits in the musical tone forming circuit 45.

As is apparent from the above description, according to this invention, the key corresponding control voltages are generated in addition to the tone pitch voltages so that the various elements of musical tones are controlled in accordance with the control voltages. Therefore, it is possible to effect intricate tonal control for each key and to freely select and set the temperament scales of produced tones. While the tone pitch voltages are proportional to the tone pitches of the keys, the key corresponding control voltages in this invention can be set to desired values because they correspond to the keys but are independent of the tone pitches thereof. Accordingly, the key corresponding control voltages can be utilized for controlling the various tonal elements. Furthermore, according to the invention, the construction of the key corresponding control voltage generating circuit can be simplified, which leads to a reduction in manufacturing cost.

What is claimed is:

1. An electronic musical instrument in which tone pitch determining voltages corresponding to respective tone pitches of a plurality of keys and key corresponding control voltages corresponding respectively to said keys are produced separately upon depression of the keys, and said instrument comprising:

musical tone generating elements in which the pitch of the generated tones are determined principally according to tone pitch determining voltages, and in which the operation of said elements is modified by said key corresponding control voltages correspondingly to modify the characteristics of the generated tones, together with means for forming said key corresponding control voltages comprising:

a voltage generating circuit for generating a plurality of voltages which are different in polarity and value from each other;

a voltage division circuit whose both input terminals are connected to a first plurality of gates;

a gate control circuit for selecting the outputs of said voltage generating circuit by controlling said first plurality of gates in accordance with one of two kinds of information both established by depression of said keys, one kind being related to groups of keys, the other kind being related to keys within said groups, so as to cause said outputs to be applied to the input terminals of said voltage division circuit; and a second plurality of gates for gating out voltages produced by said voltage division circuit in accordance with the other of said two kinds of information thereby producing control voltages corresponding to the respective keys.

2. An electronic musical instrument as defined in claim 1 wherein said gate control circuit operates in such a manner that when said voltage division circuit is supplied with a voltage of one polarity by opening at least one of the gates of said first plurality connected to one of said input terminals, said voltage division circuit is grounded at the other of said input terminals by opening at least one of the other gates of said first plurality connected to said other input terminal.

3. An electronic musical instrument as defined in claim 1, in which said voltage generating circuit includes another voltage division circuit having voltage dividing taps connected to at least a part of said first plurality of gates and two input terminals one of which is connected to a positive voltage supply and the other to a negative voltage supply.

4. An electronic musical instrument as defined in claim 3, in which said another voltage division circuit has a grounded center tap.

5. An electronic musical instrument as defined in claim 1, in which said voltage division circuit comprises a resistance ladder circuit.

6. An electronic musical instrument as defined in claim 1 further comprising:

separate key-on signal means for producing a key-on signal for each key, said key-on signal indicating when the corresponding key is depressed, said signal being used by said musical tone generating elements to initiate and begin termination of tone generation independent of said key corresponding control voltages.

7. An electronic musical instrument as defined in claim 1 wherein said one kind of information is octave related and wherein the other kind of information is note related.

* * * * *